US006235115B1

(12) United States Patent
Bassett et al.

(10) Patent No.: US 6,235,115 B1
(45) Date of Patent: May 22, 2001

(54) FOUNTAIN COATING APPLICATOR AND SUPPORT BEAM

(75) Inventors: William J. Bassett, Orfordville; Roger L. Goecks, Beloit, both of WI (US)

(73) Assignee: Beloit Technologies, Inc., Wilmington, DE (US)

( * ) Notice: Subject to any disclaimer, the term of this patent is extended or adjusted under 35 U.S.C. 154(b) by 0 days.

(21) Appl. No.: 09/226,700

(22) Filed: Jan. 7, 1999

Related U.S. Application Data

(60) Provisional application No. 60/072,742, filed on Jan. 27, 1998.

(51) Int. Cl.[7] ..... B05C 3/02

(52) U.S. Cl. ..... 118/410; 118/302; 118/419

(58) Field of Search ..... 118/325, 302, 118/410, 419

(56) References Cited

U.S. PATENT DOCUMENTS

| | | | | |
|---|---|---|---|---|
| 3,134,126 | * | 5/1964 | Phillips . | |
| 5,199,991 | | 4/1993 | Chance . | |
| 5,269,846 | | 12/1993 | Eskelinen et al. . | |
| 5,480,486 | | 1/1996 | Burns . | |
| 6,053,979 | * | 4/2000 | Bernert et al. | 118/419 |

FOREIGN PATENT DOCUMENTS

| | | |
|---|---|---|
| 4432177 | 3/1996 | (DE) . |
| 4432180 | 3/1996 | (DE) . |
| 4432180A1 | 3/1996 | (DE) . |
| 385301 | 2/1990 | (EP) . |
| 0385301 | 9/1990 | (EP) . |
| 514735 | 5/1992 | (EP) . |
| 0514735A1 | 11/1992 | (EP) . |
| 0781608A2 | 7/1997 | (EP) . |
| 781608 | 7/1997 | (EP) . |
| WO 96/07790 | 3/1996 | (WO) . |
| WO 98/21408 | 5/1998 | (WO) . |

OTHER PUBLICATIONS

European Search Report–EP99630010–Mar. 10, 2000.

"BA 1500™ Coater: Versatile, high speed blade applicator produces quality coated papers," a brochure published by Rader Companies, a Division of Beloit Corporation.

"New Coating Technologies Combine High Speeds with Higher Quality," an article publised in Pulp & Paper, by Andy Harrison, pp. 60–64, May 1994.

* cited by examiner

*Primary Examiner*—Brenda A. Lamb
(74) *Attorney, Agent, or Firm*—Lathrop & Clark LLP

(57) ABSTRACT

Two coating supply tubes extend parallel to one another and run the full width of a moving substrate in the cross machine direction. Coating is supplied separately to each supply tube from opposite ends. The supply tubes discharge coating through spaced metering holes into an application chamber defined between a sidewall mounted to each supply tube. The counterflow arrangement of the coating supply tubes results in the fall off of coating pressure in one tube being canceled out by the increased pressure in the other tube. The fall off may be further counteracted by varying the spacing between metering holes the greater the distance from the coating inlet, by varying the diameter of the metering holes, or both. The tendency of the heated coating to cause a temperature gradient may be counteracted by cantilevering the applicator head on arms from a support beam through which a temperature-controlling fluid is circulated.

11 Claims, 3 Drawing Sheets

FOUNTAIN COATING APPLICATOR AND SUPPORT BEAM

CROSS REFERENCES TO RELATED APPLICATIONS

This application claims the benefit of U.S. Provisional Patent Application No. 60/072,742, filed Jan. 27, 1998, the disclosure of which is incorporated by reference herein.

STATEMENT AS TO RIGHTS TO INVENTIONS MADE UNDER FEDERALLY SPONSORED RESEARCH AND DEVELOPMENT

BACKGROUND OF THE INVENTION

The present invention relates to coating applicators in general and to apparatus for applying coatings to moving substrates in particular.

Paper of specialized performance characteristics may be created by applying a thin layer of coating material to one or both sides of the paper. One type of coating fluid is a mixture of a fine plate-like mineral, typically clay or particulate calcium carbonate; coloring agents, typically titanium dioxide for a white sheet; and a binder which may be of the organic type or of a synthetic composition. Another type of fluid is a starch and water solution used in sizing applications. Coated paper is typically used in magazines, commercial catalogs and advertising inserts in newspapers. The coated paper may be formed with a smooth bright surface which improves the readability of the text and the quality of photographic reproductions. Coated papers are divided into a number of grades. The higher value grades, the so-called coated free-sheet, are formed of paper fibers wherein the lignin has been removed by digestion. Less expensive grades of coated paper contain ten percent or more groundwood pulp which is less expensive than pulp formed by digestion.

Coated papers are often used for high-quality printing or in other applications where visible variations in coating weight would significantly detract from the appearance of the paper. It is therefore of key concern to maintain coating thickness consistency across the width of the treated web. Greater efficiency and cost control in papermaking has driven the construction of ever wider papermaking machines, sometimes of 300–400 inches or more. In conventional fountain applicators, a single supply chamber extends the full width of the web in the cross machine direction. This supply chamber may be fed from one or both ends. To minimize fall off of coating ejected from a nozzle which terminates the supply chamber, coating is supplied at a high pressure. Nevertheless, such coaters are prone to heavier coating application at the ends.

Furthermore, the heated coatings which are frequently employed can, over the extended cross machine width of the coater head, result in temperature gradients which cause bowing of the head with resultant coat weight variations.

What is needed is a papermaking fountain applicator which may be operated at lower pressures while still supplying consistent coating levels to the substrate in the cross machine direction.

SUMMARY OF THE INVENTION

The coating applicator of this invention has two coating supply tubes which extend parallel to one another and run the full width of the substrate in the cross machine direction. Coating is supplied separately to each supply tube from opposite ends. The supply tubes discharge coating through spaced metering holes into an application chamber defined between a sidewall mounted to each supply tube. The counterflow arrangement of the coating supply tubes results in the fall off of coating pressure in one tube being canceled out by the increased pressure in the other tube at any particular point moving across the coater head in the cross machine direction. The tendency of the pressure to fall as the coating moves through the supply tube may be further counteracted by varying the spacing between metering holes with cross machine position, by varying the diameter of the metering holes, or both.

The tendency of the heated coating to cause a temperature gradient in the applicator head may be counteracted by cantilevering the applicator head on arms from a support beam through which a temperature-controlling fluid is circulated.

It is a feature of the present invention to provide a coating applicator which supplies a coating to a jet applicator nozzle at a constant pressure.

It is another feature of the present invention to provide a coating applicator which is conveniently profile controlled.

It is an additional feature of the present invention to provide a papermaking coating applicator which is less susceptible to bowing due to temperature gradients.

It is also a feature of the present invention to provide a papermaking coating applicator which operates at reduced coating pressures.

Further objects, features and advantages of the invention will be apparent from the following detailed description when taken in conjunction with the accompanying drawings.

DESCRIPTION OF THE PREFERRED EMBODIMENTS

Figure 1:
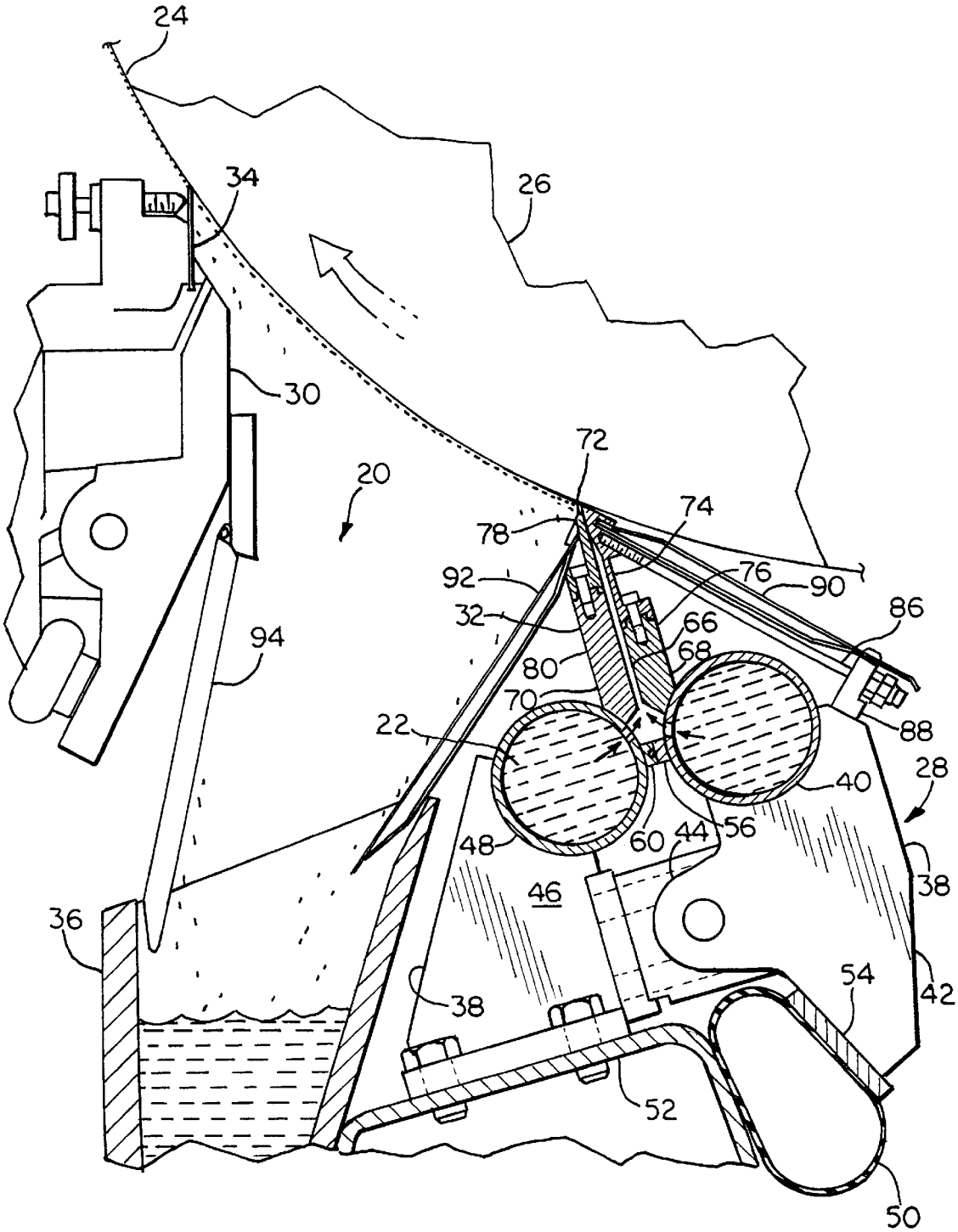
FIG. 1 is a cross-sectional view of the coating applicator of this invention on a papermaking machine.
Figure 2:
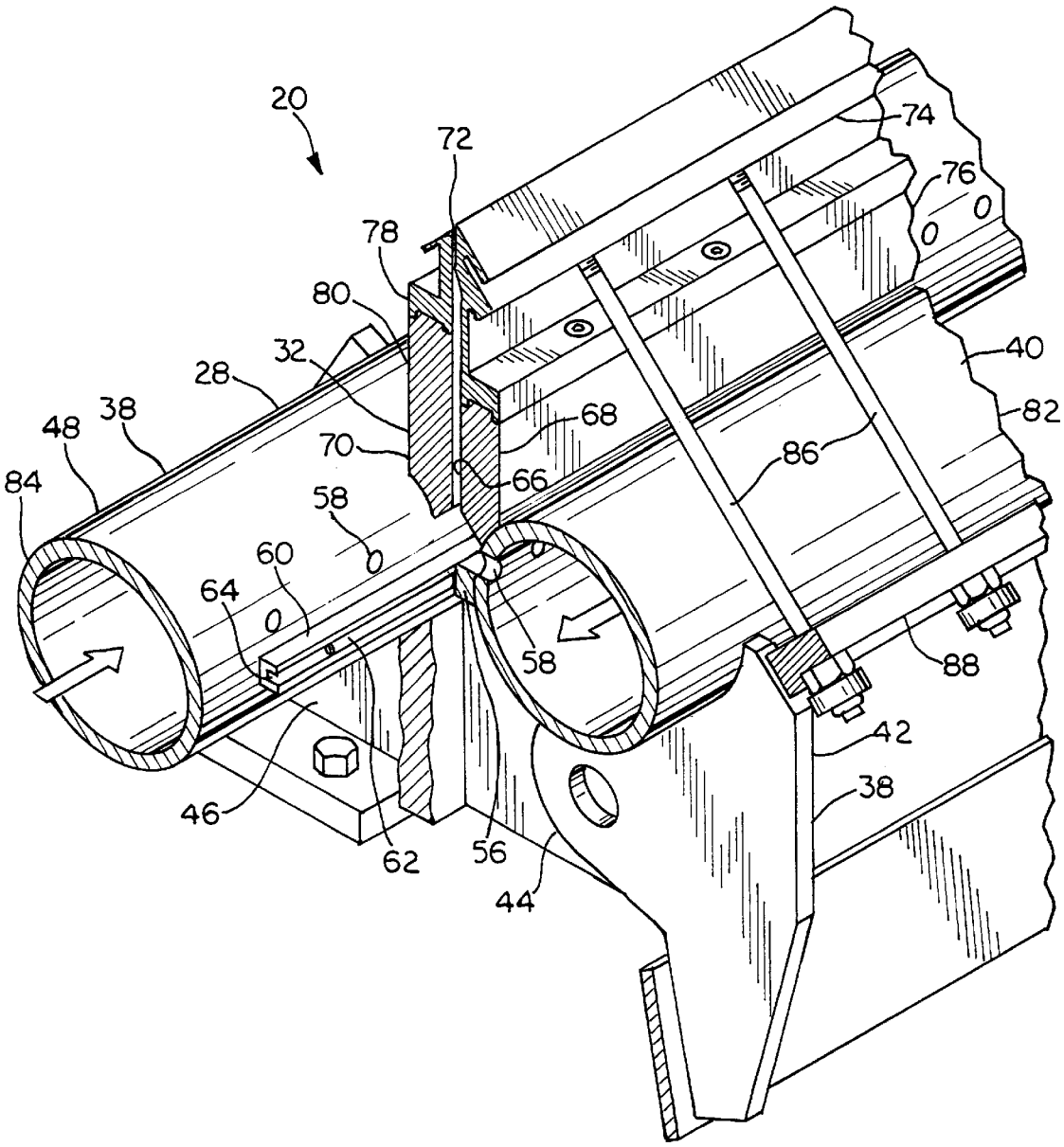
FIG. 2 is a perspective view, partially broken away in section, of the papermaking machine applicator of the apparatus of FIG. 1.
Figure 3:
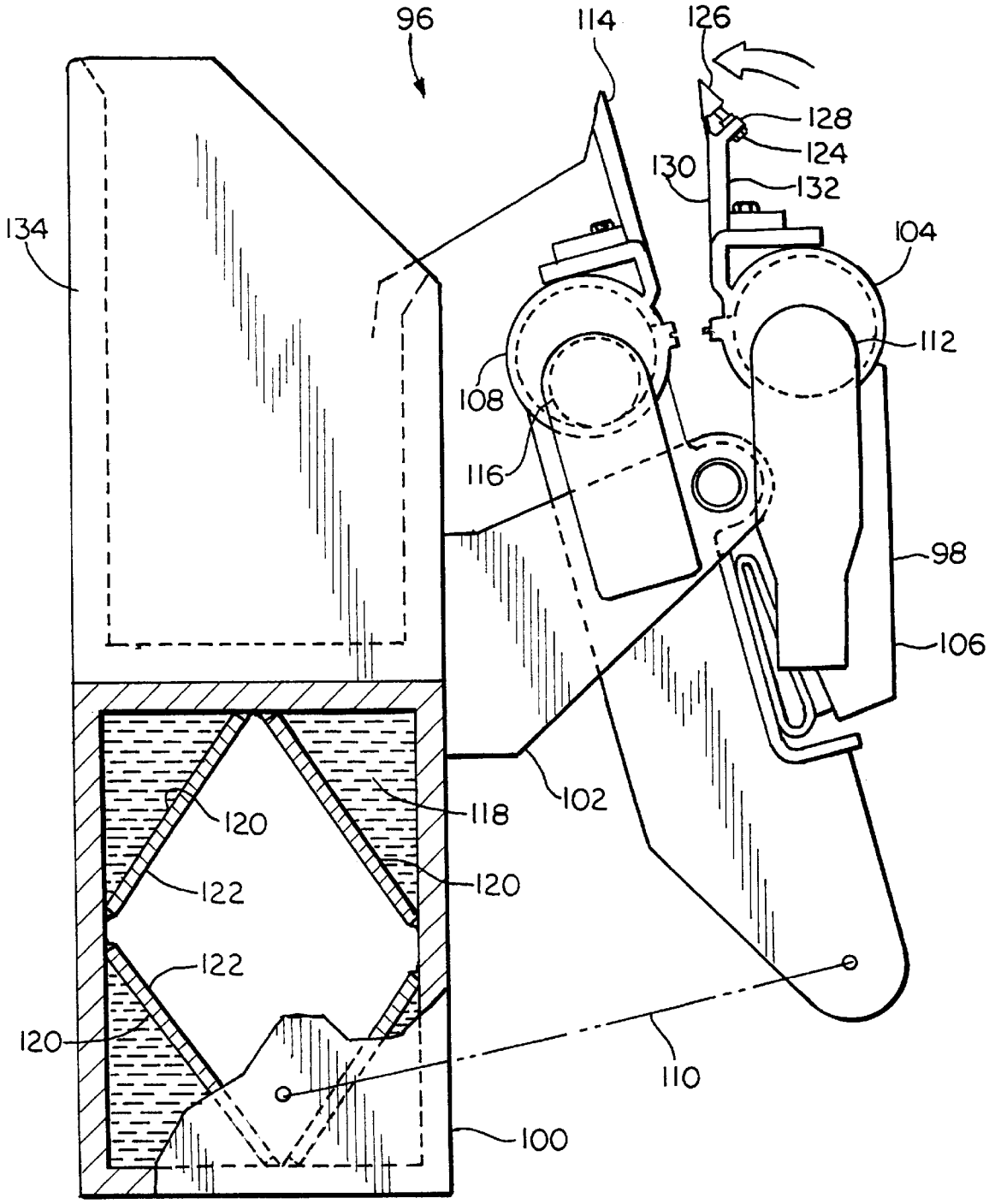
FIG. 3 is a side elevational view of an alternative embodiment coating applicator of this invention having an offset support beam with temperature maintenance.

Referring more particularly to FIGS. 1–3, wherein like numbers refer to similar parts, the coating applicator 20 of this invention is shown in FIGS. 1 and 2. The applicator 20 has two elements which control the quantity and thickness of coating 22 applied to a moving substrate, for example a paper web 24 supported by a backing roll 26. These two elements are the applicator head 28 and the metering blade assembly 30. Coating 22 is supplied under pressure to the applicator head 28 and ejected from an applicator head nozzle 32 on to the moving web 24. The metering blade 34 of the assembly 30 engages the coated web downstream of the applicator head 28 and removes excess coating 22. Applied coating which is not retained on the web is collected in a coating pan 36 and recirculated.

As shown in FIG. 2, the applicator head 28 has two segments 38 which are pivotably connected. The machine direction is defined as the direction of movement of the web 24. The cross machine direction is the direction parallel to the axis of the backing roll 26. A first coating supply tube 40 is affixed to a first bracket assembly 42 which has a series of aligned ears 44 which are rotatably mounted on brass bushings to a second bracket assembly 46 which is bolted to a rectangular support beam 52 which extends the length of the applicator head in the cross machine direction. A second coating supply tube 48 is fixed to the second bracket assembly 46. The second coating supply tube 48 extends parallel to the first coating supply tube 40. The support beam 52 is a rigid rectangular section member which may be as tall or taller than the coating applicator itself. The support beam 52 and the applicator mounted thereon will preferably be supported on pivoting arms, not shown, which allow the applicator to be withdrawn from the backing roll during start up or in the case of a sheet break.

An inflatable air tube 50 is positioned between the support beam 52 and a lower plate 54 of the first bracket assembly 42. The first coating supply tube 40 has a plurality of metering holes 58 positioned above a first chamber floor segment 56. The second coating supply tube 48 has a plurality of metering holes 58 positioned above a second chamber floor segment 60. In the operational configuration, the air tube 50 is inflated to bring the coating supply tubes together such that the first chamber floor segment 56 engages the second chamber floor segment 60. A liquid tight seal is formed between the adjacent chamber floor segments by a resilient gasket such as a cylindrical neoprene tube 62 which is received within a groove 64 defined along the center of the second chamber floor segment 60.

A nozzle chamber 66 is defined between a first wall 68 which extends upwardly from the first coating supply tube 40 and a second wall 70 which extends upwardly from the second coating supply tube 48. The first wall 68 and the second wall 70 converge to define a cross machine gap 72 through which coating is ejected from the nozzle 32. To provide for ready replacement of the terminal segments of the first wall and second wall, the first wall preferably includes a replaceable first terminal segment 74 attached to a lower portion 76 of the first wall 68; and the second wall includes a replaceable second terminal segment 78 attached to a lower portion 80 of the second wall 70.

To promote the uniformity of the jet of coating exiting from the nozzle gap 72, coating 22 is supplied to the nozzle chamber 66 through both the first coating supply tube 40 and the second coating supply tube 48. The first coating supply tube 40 has an inlet end 82 through which coating under pressure is introduced. The second coating supply tube 48 has an inlet end 84 which is spaced from the first coating supply tube inlet end 82 in the cross machine direction. The two coating supply tube inlet ends 82, 84 are spaced on opposite sides of the applicator head 28. Hence, the coating in one of the coating supply tubes flows in a direction counter to the direction of flow in the other coating supply tube. The end of each coating supply tube opposite its inlet end will preferably have a smaller outlet through which 10–20 percent of the coating leaves the coating supply tube to be recirculated. The coating supply tubes provide a means for introducing coating to the nozzle chamber in opposite but parallel directions.

When the high viscosity coating 22 is supplied to the nozzle chamber 66 through one of the coating supply tubes, there will be a pressure drop from the inlet end to the outlet end. This drop in pressure will tend to result in reduced flow velocity of the coating through the metering holes 58 adjacent the outlet end of a coating supply tube. However, because the outlet end of one coating supply tube discharges coating into the nozzle chamber adjacent the inlet end of the other coating supply tube, where the pressure is higher, the effect of the pressure drop is canceled out. Thus the falling pressure moving in the cross machine direction along one coating supply tube coincides with the rising pressure in the opposed coating supply tube moving in the same direction. The result of this arrangement is to equalize the pressure along the entire cross machine direction width of the applicator head 28. In coating supply tubes with equally spaced metering holes 58, the metering holes along one tube may be spaced apart approximately 0.5 to 4.2 inches in the cross machine direction, in a preferred embodiment the holes may be spaced from about 1.4 inches to 2.8 inches. The holes in the first coating supply tube are staggered from the holes in the second supply tube, such that a hole in one coating supply tube discharges coating into the chamber across from a land in the opposite coating supply tube.

This effect may be emphasized by adjusting the spacing between metering holes or the diameter of the metering holes. Generally, in the center region of each tube, the spacing of the holes, the diameter of the holes, or both would remain constant, with increased spacing, decreased diameter or both toward the ends of the tubes. Generally, the variation in hole diameter or spacing will occur about one meter from the end. For example, the metering holes may be spaced approximately 1.4–2.8 inches apart at the center of a coating supply tube, with the spacing being gradually increased until adjacent metering holes are approximately 2.8 to 4.2 inches apart at an end. As an alternative to varying the spacing between holes, the diameter of the holes could be varied plus or minus 50 percent. This variation would take place over the typically 400 in. width of the coating applicator 20. As an example, the nominal diameter of the holes might be about ⅜ of an inch, with a variation of plus or minus 50 percent. The coating supply tubes may be about four inches in diameter, with a range of supply tube diameter of from about 2½ inches to 10 inches. It should be noted that although cylindrical coating supply tubes are illustrated, tubes of other profile may be employed.

As shown in FIG. 1, the coating applicator 20 is provided with profiling capability by a series of threaded adjustment rods 86 which extend from a profiling bar 88 which is bolted to the first bracket assembly 42 to a series of corresponding threaded holes in the terminal segment 74 on the first nozzle wall 68. By adjusting the rods 86, the width of the gap 72 in the machine direction may be controlled as it extends in the cross machine direction. The terminal segment 74 preferably narrows or necks down below the location of attachment of the adjustment rods 86, facilitating the bending of the upper portion of the terminal segment. As shown in FIG. 2, the adjustment rods 86 in a preferred embodiment may be spaced approximately eight inches apart, but the spacing may range from two to sixteen inches.

As shown in FIG. 1, a sheet metal cover 90 extends over the adjustment rods 86, being received within a groove in the first terminal segment 74 and being screwed to the profiling bar 88. Another sheet metal cover 92 extends from the second terminal segment 78 and into the coating pan 36. Another cover 94 descends from the metering blade assembly 30 to direct coating into the coating pan 36.

An alternative embodiment applicator head assembly 96 is shown in FIG. 3. The assembly 96 thermally isolates the applicator head 98 from the support beam 100, by cantilevering the applicator head from the support beam on a series of support arms 102, each spaced from one another in the cross machine direction approximately two feet apart. The applicator head 98 has a first coating supply tube 104 which is pivotably connected to the support arms 102. The first coating supply tube 104 is also pivotably connected to the bracket 106. A second coating supply tube 108 is fixed to the bracket 106. To adjust the angle of the applicator head 98 with respect to the support beam 100, a screw jack 110 extends between the support beam 100 and the bracket 106.

As in the applicator 20, coating is supplied to the first coating supply tube 104 at an inlet end 112 from a pressurized coating supply. Coating is simultaneously supplied to the second supply tube at an opposite end. The coating travels through the coating supply tube and enters the applicator nozzle 114. A fraction of the coating is recirculated through a recirculation outlet 116. Often coating fluid temperatures are other than the ambient temperature. On applicator heads in which the main support beam is an integral part of the applicator head, the introduction of warm coating into the applicator head can create a thermal gradient between the heated portions of the applicator head and the unheated support beam.

The applicator 96 counters this thermal gradient effect by thermally isolating the support beam 100 from the portions of the applicator head through which the heated coating flows. In addition, temperature compensating fluid, preferably water 118, is pumped through the support beam 100 to keep the support beam within a limited range of temperature and to thereby prevent temperature-gradient-induced bowing of the support beam. In a preferred embodiment, water would be maintained at the desired temperature range within a rig, not shown, and pumped into four corner chambers 120 defined by rectangular plates 122 running the entire cross machine direction length of the support beam and welded in place. Although the key requirement of the temperature compensating water 118 is that its temperature be maintained within a desired range, the water may be maintained at a level slightly above freezing, for example 40 degrees Fahrenheit. Where required by temperature gradients present in the system, temperature compensating water at different temperatures and/or flow may be introduced into one or more of each of the four corner chambers. This variation may extend so far as to discontinue flow through one or more of the chambers. With this control, it is possible to control the position of the beam.

The chilled water would tend to cause the metal support beam 100 to condense water vapor from the surrounding air. This "sweating" of the support beam would have the advantageous effect of preventing coating build-up on the support beam. The coating pan 134 is preferably connected directly to the support beam 100. The temperature compensating water 118 is recirculated to the temperature maintaining rig after having passed through the support beam.

The applicator 96 also has an alternative profiling structure, in which an array of screws 124 extend between a terminal wedge 126 and a protrusion 128 extending from a lower portion 130 of the chamber wall 132 connected to the first coating supply tube 104. The terminal wedge 126 extends from the lower portion 130 of the chamber wall on a narrow segment of material, permitting it to be urged toward the second wall 132 of the chamber to control the variation of the coating jet in the cross machine direction.

It should be noted that although the substrate has been illustrated as a paper web supported by a backing roll, the substrate may alternatively be a roll itself, which receives the coating for downstream application to a paper web, for example as in a size press. It should be noted that where coating or coating material is referred to herein, pigmented coatings, sizing solutions, and other fluids which may be applied to a paper web are included. The coating applicator of this invention may also be used in off-machine applications as well as on-machine.

It is understood that the invention is not limited to the particular construction and arrangement of parts herein illustrated and described, but embraces such modified forms thereof as come within the scope of the following claims.

We claim:

1. A coating applicator for applying a coating to a moving substrate, the applicator comprising:

a frame;

a first coating supply tube mounted to the frame, the supply tube having portions defining a plurality of first coating inlet holes;

a second coating supply tube mounted to the frame substantially parallel to the first coating supply tube, the second coating supply tube having portions defining a plurality of second coating inlet holes, a first wall which extends from the first coating supply tube toward the substrate; and a second wall which extends from the second coating supply tube toward the substrate, wherein the second wall is spaced from the first wall to define a coating application chamber which is in communication with the plurality of coating inlet holes on the first coating supply tube and the second coating supply tube, the first wall and the second wall defining a nozzle coating discharge opening through which coating is directed toward the substrate, wherein the coating is introduced into the first coating supply tube to flow in a first direction through the first coating supply tube, and the coating is introduced into the second coating supply tube to flow in a direction counter to and substantially parallel to the first direction, wherein the first supply tube is pivotably mounted to the frame such that the first supply tube and connected first wall are pivotable away from the second supply tube to permit access to the coating application chamber.

2. The coating applicator of claim 1 wherein the first coating supply tube has an inlet end and an outlet end spaced in the cross machine direction from the inlet end, and wherein the coating is introduced at a coating supply at the first coating supply tube inlet end, and wherein the second coating supply tube has an inlet end spaced in the cross machine direction opposite the first coating supply tube inlet end, such that the coating flows from each coating supply tube inlet end through the supply tubes and out the coating inlet holes into the coating application chamber, the coating in the two supply tubes flowing in opposite directions.

3. The coating applicator of claim 1 wherein the frame comprises a support beam having portions defining at least one chamber, and wherein the chamber is connected to a supply of temperature compensating fluid to permit the fluid to flow through the at least one chamber to prevent temperature-gradient-induced bowing of the support beam.

4. The coating applicator of claim 1 wherein the support beam has a plurality of substantially parallel chambers, the chambers being connected to the supply of temperature compensating fluid to prevent temperature-gradient-induced bowing of the support beam.

5. The coating applicator of claim 1 wherein the coating supply tubes have inlet and outlet ends and intermediate portions spaced between the inlet and outlet ends, and wherein the spacing between the first coating inlet holes on the first coating supply tube and the second coating inlet holes on the second coating supply tube is different adjacent the inlet and outlet ends than at the intermediate portions.

6. The coating applicator of claim 1 wherein the coating supply tubes have inlet and outlet ends and intermediate portions spaced between the inlet and outlet ends, and wherein the diameter of the first coating inlet holes on the first coating supply tube and the second coating inlet holes on the second coating supply tube is different adjacent the inlet and outlet ends than at the intermediate portions.

7. The coating applicator of claim 1 further comprising a metering blade positioned downstream of the nozzle and engaging the substrate.

8. The coating applicator of claim 1 wherein the second wall has a terminal segment which is adjustable by means of threaded rods to adjust the spacing between the first wall and the second wall of the nozzle, the threaded rods being adjustable to control the machine direction spacing of the nozzle first wall from the nozzle second wall, said spacing being variable in the cross machine direction.

9. The coating apparatus of claim 1 wherein the first coating inlet holes are separated from one another by first lands, and wherein the second coating inlet holes are separated from one another by second lands, and wherein the holes in the first coating supply tube are staggered from the holes in the second supply tube, such that a hole in one coating supply tube discharges coating into the chamber across from a land in the opposite coating supply tube.

10. A coating applicator for applying a coating to a moving substrate, the applicator comprising:

a frame;

a first coating supply tube mounted to the frame, the supply tube having portions defining a plurality of first coating inlet holes;

a second coating supply tube mounted to the frame substantially parallel to the first coating supply tube, the second coating supply tube having portions defining a plurality of second coating inlet holes, a first wall which extends from the first coating supply tube toward the substrate;

a second wall which extends from the second coating supply tube toward the substrate, wherein the second wall is spaced from the first wall to define a coating application chamber which is in communication with the plurality of coating inlet holes on the first coating supply tube and the second coating supply tube, the first wall and the second wall defining a nozzle coating discharge opening through which coating is directed toward the substrate, wherein the coating is introduced into the first coating supply tube to flow in a first direction through the first coating supply tube, and the coating is introduced into the second coating supply tube to flow in a direction counter to and substantially parallel to the first direction;

wherein the coating supply tubes have inlet and outlet ends and intermediate portions spaced between the inlet and outlet ends, and wherein the spacing between the first coating inlet holes on the first coating supply tube and the second coating inlet holes on the second coating supply is different adjacent the inlet and outlet ends than at the intermediate portions.

11. A coating applicator for applying a coating to a moving substrate, the applicator comprising:

a frame;

a first coating supply tube mounted to the frame, the supply tube having portions defining a plurality of first coating inlet holes;

a second coating supply tube mounted to the frame substantially parallel to the first coating supply tube, the second coating supply tube having portions defining a plurality of second coating inlet holes, a first wall which extends from the first coating supply tube toward the substrate; and a second wall which extends from the second coating supply tube toward the substrate, wherein the second wall is spaced from the first wall to define a coating application chamber which is in communication with the plurality of coating inlet holes on the first coating supply tube and the second coating supply tube, the first wall and the second wall defining a nozzle coating discharge opening through which coating is directed toward the substrate, wherein the coating supply tubes have inlet and outlet ends and intermediate portions spaced between the inlet and outlet ends, and wherein the diameter of the first coating inlet holes on the first coating supply tube and the second coating inlet holes on the second coating supply tube is different adjacent the inlet and outlet ends than at the intermediate portions.

* * * * *